US005138374A

United States Patent [19]

Bellis

[11] Patent Number: 5,138,374

[45] Date of Patent: Aug. 11, 1992

[54] IMAGE FORMING APPARATUS INCLUDING MEANS FOR RECEIVING AN IMAGE MEMBER CARTRIDGE

[75] Inventor: Edson F. Bellis, Macedon, N.Y.

[73] Assignee: Eastman Kodak Company, Rochester, N.Y.

[21] Appl. No.: 680,716

[22] Filed: Apr. 4, 1991

[51] Int. Cl.[5] ..... G03G 15/00

[52] U.S. Cl. ..... 355/200; 355/210

[58] Field of Search ..... 355/211, 326, 327, 210, 355/271, 277

[56] References Cited

U.S. PATENT DOCUMENTS

| | | | |
|---|---|---|---|
| 4,470,689 | 9/1984 | Nomura et al. | 355/211 |
| 4,591,258 | 5/1986 | Nishino et al. . | |
| 4,598,993 | 7/1986 | Mizutani et al. . | |
| 4,712,906 | 12/1987 | Bothner et al. . | |
| 4,876,577 | 10/1989 | Ogura et al. . | |
| 4,952,989 | 8/1990 | Kawano et al. | 355/210 |
| 4,984,026 | 1/1991 | Nishise et al. | 355/277 |
| 4,996,566 | 2/1991 | Morita et al. | 355/326 |
| 5,014,095 | 5/1991 | Yamada | 355/327 |

OTHER PUBLICATIONS

U.S. patent application Ser. No. 07/650,260, McDougal, "Image Forming Apparatus and Image Cartridge" filed Feb. 4, 1991.

*Primary Examiner*—A. T. Grimley
*Assistant Examiner*—Sandra L. Brasé
*Attorney, Agent, or Firm*—Leonard W. Treash, Jr.

[57] ABSTRACT

An image forming apparatus includes a transfer drum for superimposing different color toner images to create a multicolor iamge. The images are formed on an image member which is supplied to the apparatus in a cartridge. The cartridge is loaded in the apparatus by a first movement generally parallel to the axes of rotation of the transfer drum and the image member to a position in which the image member is spaced from and opposing the transfer drum. The cartridge is then rotated around one of its corners to move the image member into transfer engagement with the transfer drum.

7 Claims, 3 Drawing Sheets

IMAGE FORMING APPARATUS INCLUDING MEANS FOR RECEIVING AN IMAGE MEMBER CARTRIDGE

TECHNICAL FIELD

This invention relates to an image forming apparatus of the type having an image member which is loadable in the apparatus as part of an image member cartridge. It also relates to an image forming apparatus which has a transfer member which controls the transfer of toner images to a surface associated with the transfer member, for example, a transfer drum having a surface for receiving a series of different color toner images in registration to create a multicolor image on the surface of the drum.

BACKGROUND ART

U.S. Pat. No. 4,876,577, Ogura et al, issued Oct. 24, 1989 and U.S. Pat. No. 4,591,258, Nishino et al, issued May 27, 1986, are typical of a number of references showing a cartridge containing a rotatable photoconductive drum with charging and cleaning stations also within the cartridge. The cartridge is received in an image forming apparatus which rotates the drum to bring it past the charging station within the cartridge where an image surface associated with the drum is uniformly charged. An access opening permits imagewise exposure of the charged surface to create an electrostatic image. The electrostatic image is toned by application of toner either from a toning station within the cartridge or through a toning access opening by a toning station located in the image forming apparatus. Each toner image formed by such toning is then transferred to a receiving sheet which is electrostatically held to a portion of the image surface. The receiving sheet is then fed to a fixing device where the image is fixed.

U.S. Pat. No. 4,712,906 to Bothner et al, issued Dec. 15, 1987, shows, in FIG. 1, a color electrophotographic apparatus in which a series of different color toner images carried on an image member are transferred in registration to a receiving sheet carried on the surface of a transfer drum. The transfer drum is rotated to bring the receiving surface of the receiving sheet continually into transfer relation with the image member to superimpose the toner images creating a multicolor image. The receiving sheet is stripped from either the transfer drum or image member and fixed to create a multicolor copy or print. FIG. 8 of that patent also shows a similar approach, generally known in the art, in which a series of different color toner images are transferred in registration to the outside surface of a transfer drum itself to create a multicolor toner image on that surface. The multicolor image is then transferred in a single step to a receiving sheet at a position remote from the image member. This latter approach has a substantial advantage over the more conventional FIG. 1 approach of not having to attach the receiving sheet directly to the surface of the transfer drum. This makes available a larger variety of receiving sheets and greatly reduces the complexity of the transfer drum.

U.S. patent application Ser. No. 07/650,260, McDougal, IMAGE FORMING APPARATUS AND IMAGE MEMBER CARTRIDGE, filed Feb. 4, 1991, shows an image forming apparatus having a transfer drum to which toner images are transferred to form a multicolor image from an image member that is loadable in the apparatus in an image member cartridge. The cartridge is loadable from the top or side of the apparatus to position the image member in contact with the transfer drum. To load from the top the top portion of the apparatus lifts away from the lower part. The transfer drum is driven by the main drive of the apparatus which, in turn, drives the image member through frictional engagement of their outer surfaces, a feature which greatly simplifies the design of the cartridge.

U.S. Pat. No. 4,598,993, Mizutani et al, issued Jul. 8, 1986, shows a common design of an image member cartridge which is loadable in image forming apparatus by sliding the cartridge in a direction parallel to the axis of rotation of the image member. Projections on the cartridge mate with guide surfaces or grooves in the receiving portion of the image forming apparatus to facilitate this type of loading. This general approach to loading image member cartridges is convenient and somewhat simplifies the apparatus itself.

DISCLOSURE OF THE INVENTION

It is an object of the invention to provide an image forming apparatus having a transfer member engageable with a cartridge containing an image member, which cartridge is loadable into the apparatus by movement of the cartridge generally parallel to the axis of rotation of the image member.

This and other objects are accomplished by an image forming apparatus which includes a transfer member positioned to engage an image member supplied in a cartridge. Guide means are positioned to guide the cartridge for movement in a first direction generally parallel to axes of rotation of the image member and transfer member from a position outside the image forming apparatus to a position in which the image member is parallel to and spaced from the transfer member. The apparatus further includes means for moving the cartridge in a second direction generally transverse to the first direction to bring the image member into engagement with the transfer member.

According to a preferred embodiment, engagement of the transfer member and image member by movement in the second direction is accomplished by rotating the cartridge around an axis or pivot parallel to the axis of rotation of the image member.

According to a further preferred embodiment, means are provided to assure that the cartridge moves into the image forming apparatus along a path sufficiently separated from the transfer member that the cartridge will not injure the transfer member during this movement in the first direction.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
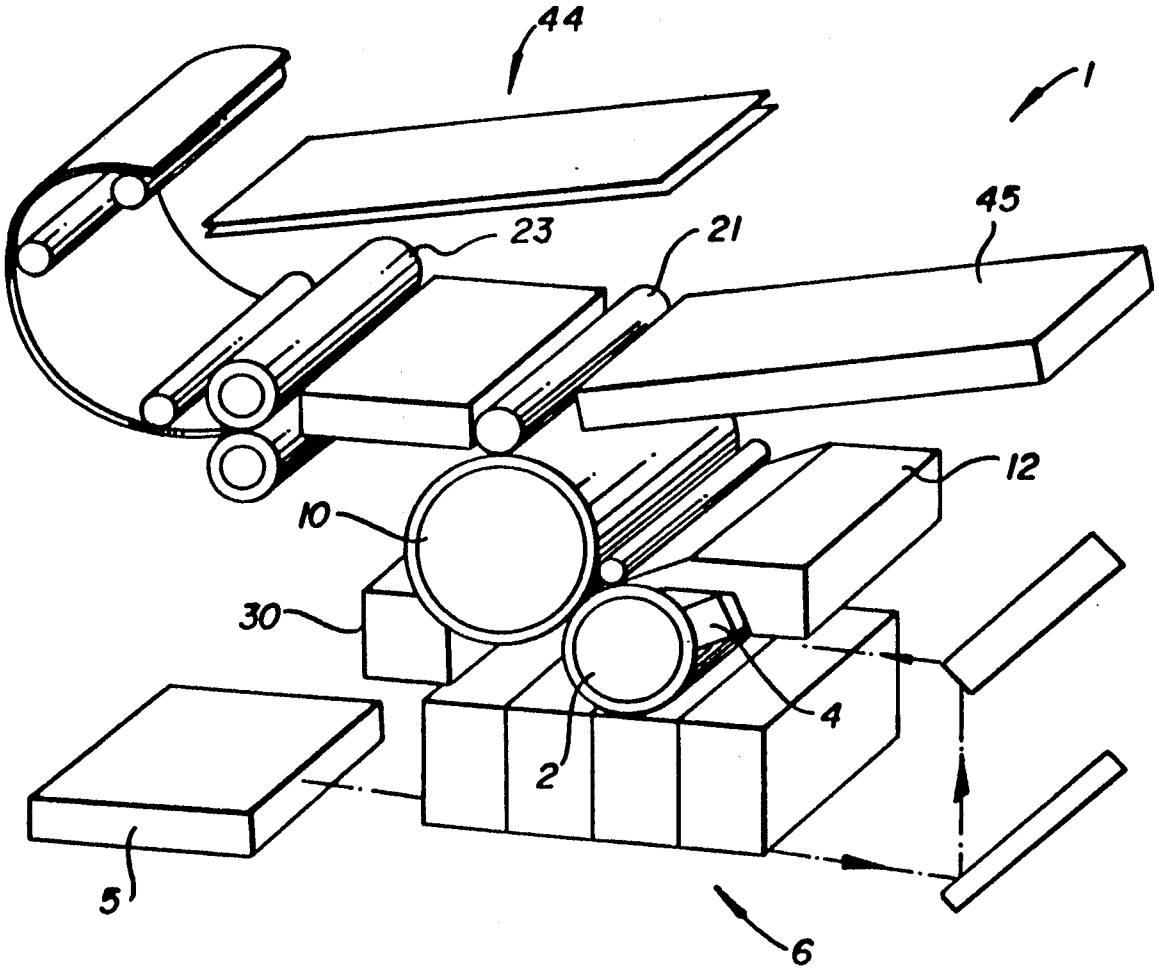
FIG. 1 is a perspective schematic of an image forming apparatus in which the invention is usable, showing basic component parts with many parts and virtually all housing structure eliminated for clarity of illustration.

The invention is particularly usable in an image forming apparatus, for example, a printer 1 shown in FIG. 1. Printer 1 includes an image member, for example, a photoconductive drum 2 which is journaled for rotation past a series of stations including a charging station 4 which lays down a uniform charge on an outer cylindrical image surface of image member 2. The uniformly charged image surface is imagewise exposed by a laser 5 to form a series of electrostatic images. The electrostatic images are toned by applying toners of different colors by a development device 6 to create a series of different color toner images on the image surface of image member 2. The different color toner images are transferred in registration to the outside surface of a transfer drum 10 to form a multicolor image as transfer drum 10 repeatedly rotates through transfer relation with image member 2. The multicolor toner image on the surface of transfer drum 10 is transferred to a receiving sheet fed from a receiving sheet supply 45 into transfer relation with drum 10 at a transfer station 21. The receiving sheet is then fed to a fuser 23. The multicolor image is fused to a transfer sheet by the application of heat and pressure. The receiving sheet with the fixed toner image thereon is then conveyed through an inverting path to an output hopper already containing other receiving sheets as shown at 44. The transfer drum 10 is cleaned by articulatable cleaner 30 after transfer of images. The photoconductive drum 2 is continuously cleaned by an image member cleaning device 12.

Development device 6 includes four toning stations, each containing a different color toner. Device 6 is moved horizontally to sequentially present the stations to image member 2 to apply the different toners to the images.

Figure 2:
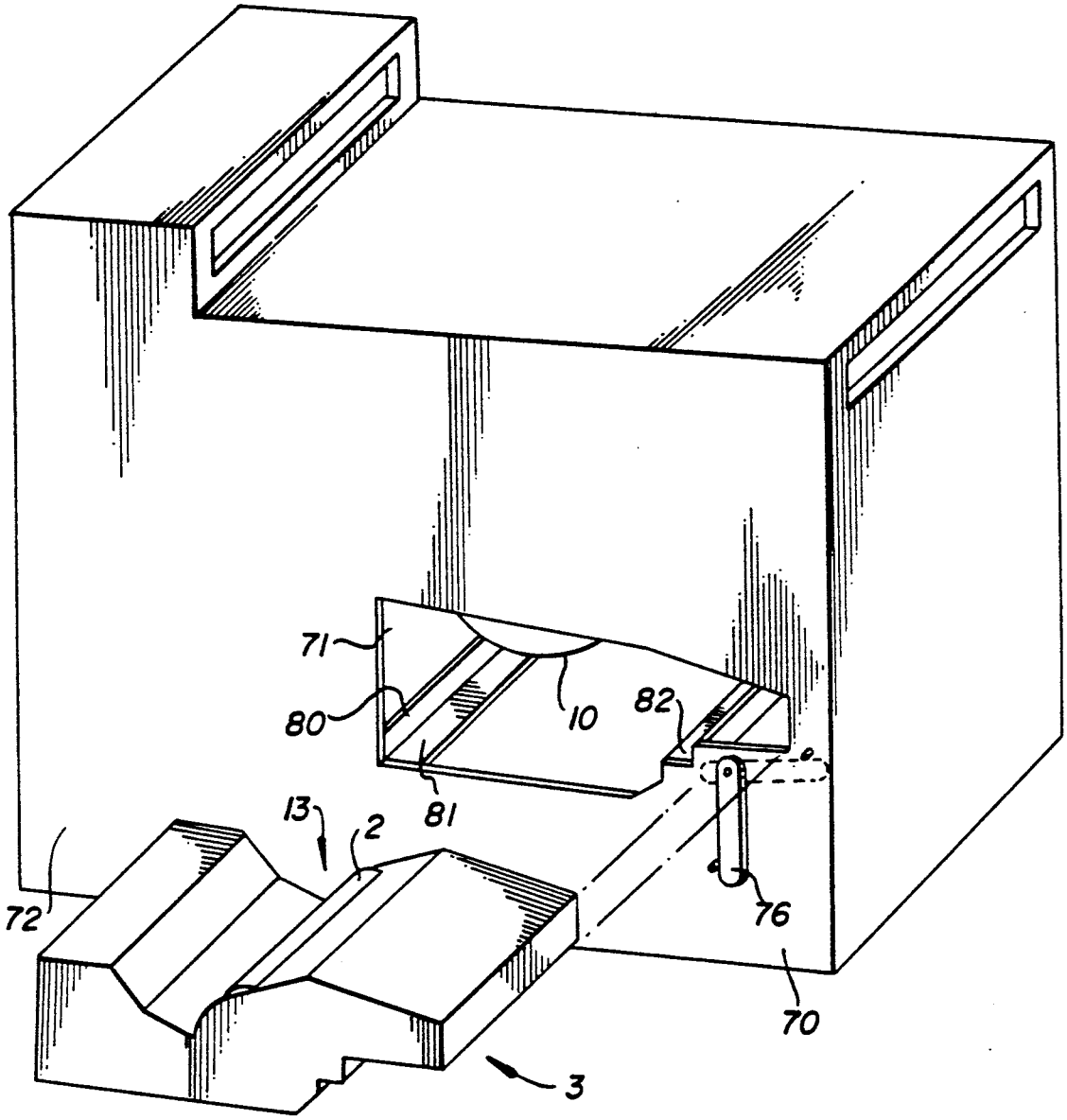
FIG. 2 is a front perspective view of an image forming apparatus constructed according to the invention illustrating insertion of an image member cartridge in the apparatus.
Figures 3, 4:
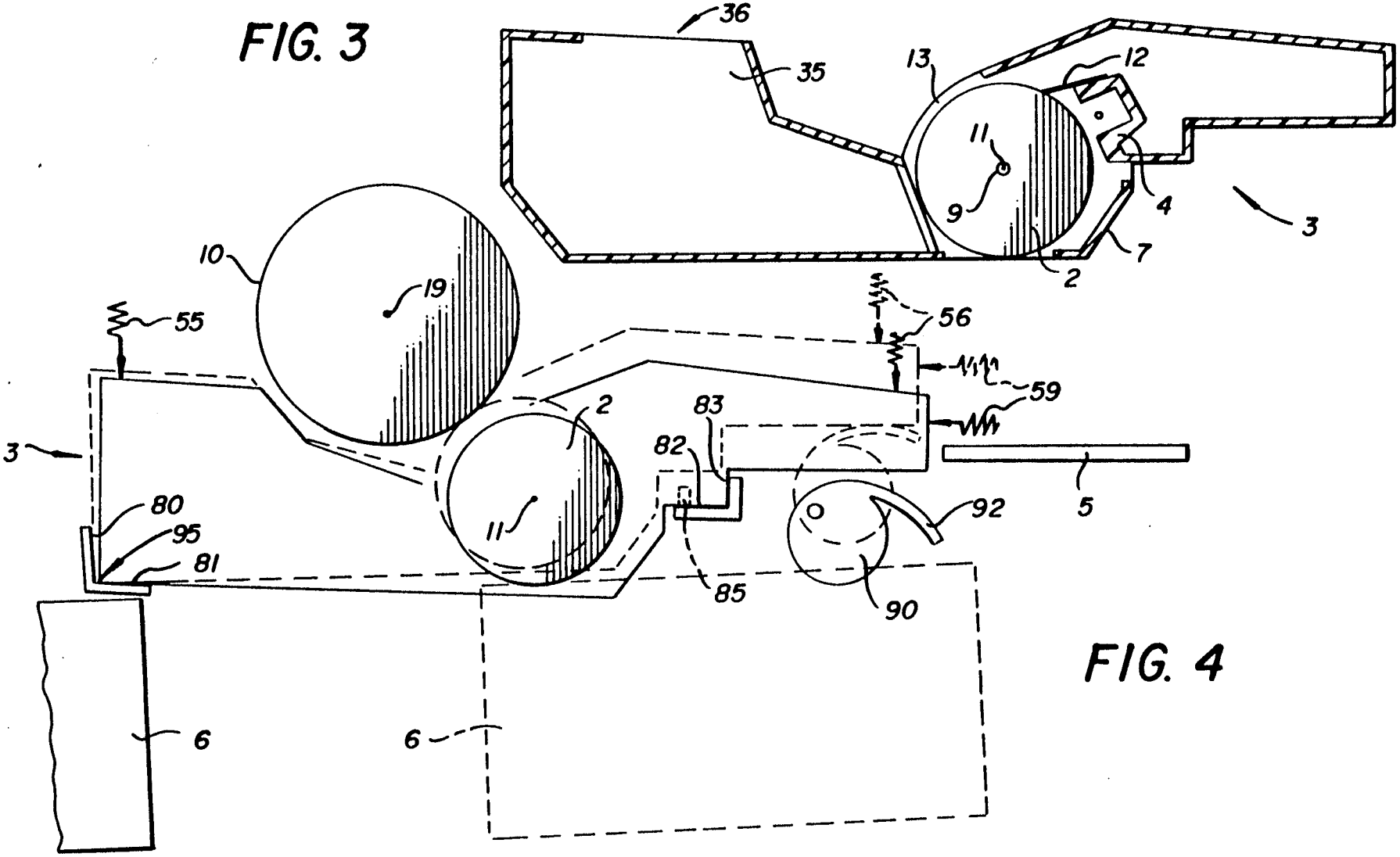
FIG. 3 is a front section of an image member cartridge also shown in perspective in FIG. 2.
FIG. 4 is a front schematic of an image member cartridge, also showing certain of the key elements of the image forming apparatus for receiving the cartridge with the operational position of the cartridge shown in phantom.

To easily replace the image member 2, charging device 4 and cleaning device 12 are all included in an image member cartridge 3, not shown in FIG. 1, but shown in detail in FIGS. 2–4. Referring especially to FIG. 3, image member cartridge 3 includes photoconductive drum 2, charging device 4 and cleaning device 12, enclosed in a cartridge housing 7. Drum 2 is supported on a shaft 9 for rotation about an axis of rotation 11. It is rotatable by engagement with transfer drum 10 (FIG. 1), which is also rotatable about an axis of rotation 19 (FIG. 4) which is parallel to axis 11. The drums are engageable through a transfer opening 13 in housing 7.

Cartridge 3 also includes a chamber 35 having an opening 36 for receiving toner cleaned off transfer drum 10 by articulatable cleaning device 30.

Cartridge 3 is loaded in image forming apparatus 1 in a 2-step process. The first step is illustrated in FIG. 2. Image forming apparatus 1 has a housing 70 having a front wall 72 through which is cut a hole 71 through which cartridge 3 is inserted. Cartridge 3 is moved by the operator in a first direction generally parallel to the axes of rotation 11 and 19 along a set of guide surfaces 80, 81, 82 and 83 until cartridge 3 reaches a stop 85 shown in phantom in FIG. 4. During this movement parallel to the axes, it is important that cartridge 3 not engage transfer drum 10 to avoid injury to the image receiving surface. To prevent such engagement, means are provided to ensure that cartridge 3 maintains contact with guide surfaces 81 and 82 during this movement. The top surface of hole 71 can be positioned to inhibit movements substantially away from surfaces 81 and 82. However, it is preferable to have a pair of leaf springs, shown schematically at 55 and 56 in FIG. 4 which are light springs that engage the top surface of cartridge 3. Springs 55 and 56 urge the cartridge against surfaces 81 and 82 as the cartridge moves in the first direction.

Once cartridge 3 has engaged stop 85, axes 11 and 19 will be generally parallel with each other and their image carrying surfaces directly opposed and slightly spaced from each other. At this point, a handle 76 (FIG. 2) located on front 72 of image forming apparatus 1 is rotated in a counterclockwise direction to the position shown in FIG. 2 in phantom. Rotation of handle 76 rotates a pair of cams 90 shown in FIG. 4. Cams 90 are located near the front and back walls of apparatus 1 so that they do not interfere with the optical path of laser 5. When rotated, resilient portions 92 of cams 90 engage the bottom of cartridge 3 opposite leaf spring 56 and urge cartridge 3 working against spring 56 to pivot about an axis 95 at the diagonally opposite corner of the cartridge 3. This pivotal movement brings image member 2 into engagement with transfer member 10. In this process, spring 92 overcomes the effects of springs 55 and 56 with enough net rotational force to provide an appropriate sized nip between image member 2 and transfer member 10.

For highest quality image transfer, it is important that axes 11 and 19 are parallel during operation of the apparatus. This will require relatively accurate front to back positioning of surfaces 80 and 81 as well as the corner of cartridge 3 forming with surfaces 80 and 81 the pivot 95. An additional spring 59 is shown schematically in FIG. 4 which urges cartridge 3 toward surface 80. It can be lightly applied throughout the inserting process or applied as part of rotation of handle 76.

Other spring designs will be apparent to those skilled in the art, including designs in which the functions of both springs 92 and 59 are accomplished with a single properly directed spring.

Note that development device 6 has been moved to the far right during the insertion process so that it does not interfere with movement of cartridge 3. This aspect of the design allows the development device to be positioned quite close to the bottom of a received cartridge 3 during operation.

Rotation of cams 90 can be accomplished by means other than handle 76. For example, a door (not shown) covering hole 71 can rotate cams 90 in a clockwise direction when being opened and in a counterclockwise direction when being closed to provide a sense of automation to the final seating of the cartridge. Cams 90 could also be connected to the main drive of the apparatus and rotated in a counterclockwise direction each time the apparatus is powered up and in a counterclockwise direction when powering down.

The invention has been described in detail with particular reference to a preferred embodiment thereof, but it will be understood that variations and modifications can be effected within the spirit and scope of the invention as described hereinabove and as defined in the appended claims.

I claim:

1. An image forming apparatus comprising:

an apparatus housing containing a transfer member having a fixed axis of rotation, a cartridge having a cartridge housing and containing an image member having an axis of rotation and movable past a series of stations to create a series of different color toner images on said image member, said transfer member and image member having outer surfaces which engage each other during rotation about said axes of rotation to transfer the toner images to a receiving surface associated with said transfer member in registration to create a multicolor toner image, and cartridge receiving means in said image forming apparatus for receiving said cartridge, said cartridge receiving means including, guide means, fixed with respect to said transfer member, for guiding said cartridge for movement in a direction generally parallel to said axes of rotation from a position outside of said housing to an inserted position in said housing with said image member spaced from said transfer member, and means for moving said cartridge in a direction generally transverse to said axes of rotation to bring said image member away from at least a portion of said guide means and into engagement with said transfer member.

2. An image forming apparatus comprising:

a series of components arranged to form color images on receiving sheets, an apparatus housing containing some of said components including a transfer member, a cartridge containing others of said components and including an image member, said transfer member having an axis of rotation, guide means within said apparatus housing and fixed with respect to said transfer drum, for guiding said cartridge for movement in a direction generally parallel to the axis of rotation of said transfer member from a position outside of said housing to an inserted position in said housing with the image member spaced from said transfer member, and means in said apparatus housing for rotating said cartridge in a direction bringing the image member into transfer engagement with said transfer member.

3. An image forming apparatus for use with a cartridge of the type having a cartridge housing containing an image member which image member is rotatable about an axis of rotation and accessible from outside said cartridge housing, said image forming apparatus comprising:

a cylindrical transfer drum having an axis of rotation, means for receiving such a cartridge and for positioning its image member in transfer engagement with said transfer drum, said means including guide means, fixed with respect to said transfer drum, for guiding said cartridge for movement in a direction generally parallel to said axes of rotation from a position outside of said housing to an inserted position in said housing with said image member spaced from said transfer drum, and means for rotating a received cartridge in a direction bringing its image member away from at least a portion of the guide means and into transfer engagement with the transfer drum.

4. An image forming apparatus according to claim 3 wherein said means for rotating is a resilient means that is engageable with a first end of a received cartridge to rotate said cartridge about a pivot located generally at an opposite end of such a cartridge and disposed in a direction parallel to the axes of rotation.

5. An image forming apparatus according to claim 4 wherein said means for rotating further includes a handle accessible to an operator outside the apparatus for applying said resilient means to a received cartridge.

6. An image forming apparatus according to claim 4 wherein said guide means is positioned to guide a received cartridge to a position generally below said transfer drum and said urging means is applied to a bottom surface of a received cartridge to generally rotate said cartridge in a direction moving its image member upwardly into engagement with said transfer drum.

7. An image forming apparatus according to claim 6 further including spring means engageable with said cartridge urging said cartridge in a downward direction during movement of said cartridge in a direction parallel to the axis of rotation of said transfer drum to inhibit engagement between said cartridge and said transfer drum during such movement.

* * * * *